US010136719B2

(12) United States Patent
Nesbitt

(10) Patent No.: US 10,136,719 B2
(45) Date of Patent: Nov. 27, 2018

(54) FLUID APPLICATOR SYSTEMS

(71) Applicant: Tammy Nesbitt, Greensboro, GA (US)

(72) Inventor: Tammy Nesbitt, Greensboro, GA (US)

( * ) Notice: Subject to any disclaimer, the term of this patent is extended or adjusted under 35 U.S.C. 154(b) by 0 days.

(21) Appl. No.: 15/228,535

(22) Filed: Aug. 4, 2016

(65) Prior Publication Data

US 2018/0035782 A1 Feb. 8, 2018

(51) Int. Cl.
*A45D 34/04* (2006.01)

(52) U.S. Cl.
CPC ..... *A45D 34/045* (2013.01)

(58) Field of Classification Search
CPC ..... A45D 34/045
USPC ..... 401/127
See application file for complete search history.

(56) References Cited

U.S. PATENT DOCUMENTS 2,325,164 A * 7/1943 Goodwin ..... B67B 3/02 200/61.58 R
2,411,435 A * 11/1946 Kirschenbaum ..... B65D 47/18 222/421
2,676,060 A * 4/1954 Montenier ..... A61M 11/02 239/327
3,121,429 A * 2/1964 Costa ..... A45D 34/04 222/569
4,690,579 A * 9/1987 Tuckman ..... A45D 40/265 141/24
4,717,032 A * 1/1988 Wu ..... A45D 40/265 215/228
5,007,755 A * 4/1991 Thompson ..... A45D 40/04 401/171
5,316,399 A * 5/1994 Joulia ..... B65D 51/32 215/303
5,505,041 A * 4/1996 Harlan ..... A45D 40/04 206/385
5,518,715 A * 5/1996 Rosenblatt ..... A45D 40/04 401/174
5,690,441 A * 11/1997 McManus ..... A46B 11/0006 401/122
6,164,857 A * 12/2000 Wolfarth-Brooks ..... A45D 34/045 401/126
6,336,763 B1 * 1/2002 Losier ..... A45D 40/04 401/205
6,773,186 B1 * 8/2004 Shih ..... A45D 33/34 401/127
6,789,970 B1 * 9/2004 Shearon ..... A46B 7/023 401/127
6,821,044 B1 * 11/2004 Podejko ..... A45D 34/045 401/126
7,066,675 B1 * 6/2006 Miller ..... A45D 29/007 401/126
8,007,192 B2 * 8/2011 Huang ..... A45D 34/045 401/126
8,021,065 B2 * 9/2011 Lou ..... A45D 40/265 132/119.1
8,469,041 B2 * 6/2013 Pires ..... A45D 40/262 132/218

(Continued)

*Primary Examiner* — Lori Baker
(74) *Attorney, Agent, or Firm* — Kilpatrick Townsend & Stockton LLP

(57) ABSTRACT

Embodiments of the present invention provide fluid applicator systems that allow access to product located at the bottom of the bottle toward the end of the useful lifetime of the product. There is provided a platform that moves with respect to the bottle base and an applicator that moves with respect to the cap.

18 Claims, 8 Drawing Sheets

(56) References Cited

U.S. PATENT DOCUMENTS

| | | | | |
|---|---|---|---|---|
| 8,967,895 | B2 * | 3/2015 | Svendsen | A45D 34/045 132/218 |
| 9,167,881 | B2 * | 10/2015 | Mehta | A45D 34/045 |
| 9,326,583 | B2 * | 5/2016 | Pires | A45D 40/265 |
| 2003/0147685 | A1 * | 8/2003 | Epli | A45D 34/045 401/127 |
| 2006/0032512 | A1 * | 2/2006 | Kress | A45D 40/262 132/218 |
| 2006/0039744 | A1 * | 2/2006 | Dumler | A45D 34/04 401/291 |
| 2006/0272667 | A1 * | 12/2006 | Wyatt | A45D 40/265 132/218 |
| 2006/0279181 | A1 * | 12/2006 | Gueret | A45D 40/262 312/218 |
| 2008/0011316 | A1 * | 1/2008 | Malvar | A46B 9/021 132/218 |
| 2008/0260450 | A1 * | 10/2008 | Sanchez | A45D 33/32 401/126 |
| 2012/0093565 | A1 * | 4/2012 | Drew | B65D 83/0011 401/68 |
| 2016/0067287 | A1 * | 3/2016 | McQueen | A61L 26/0095 424/489 |
| 2016/0096010 | A1 * | 4/2016 | Klein | A61F 6/005 604/514 |
| 2016/0198834 | A1 * | 7/2016 | Kim | A45D 40/267 401/129 |
| 2017/0347773 | A1 * | 12/2017 | Seidler | A45D 40/023 |
| 2018/0000223 | A1 * | 1/2018 | Bell | A45D 34/041 |

* cited by examiner

FLUID APPLICATOR SYSTEMS

FIELD OF THE DISCLOSURE

Embodiments of the present disclosure relate generally to fluid applicator systems. Specific embodiments provide a nail polish bottle and applicator brush/cap improvements that are designed for accessing polish that may otherwise remain unused at the bottom of the bottle.

BACKGROUND

Conventional nail polish bottles have a volume capacity of about 10 to about 15 mL. The contents of conventional bottles cannot always be completely used because the applicator brush often does not reach the very bottom of the bottle. Accordingly, manicurists and other nail polish users typically need to tilt the nail polish bottle to the side, while swirling the cap (to which the applicator brush is attached) around in order to try to reach the remainder of the polish product at the bottom of the bottle. Additionally, due to its extended residence time in the bottle, the nail polish product may become thick, gunky, and/or unable to use, resulting in potential waste.

Some improvements to conventional nail polish bottles have been attempted. For example, some have designed nail polish pens, which have a brush secured at the tip of the pen-shaped applicator. The user squeezes the pen-shaped applicator in order to force product out of the bottle, into and through the brush. These products have met with limited success. One reason is that the polish product can get stuck at the bottom of the pen-shaped applicator and not be delivered to the brush properly.

Other improvements have sought to change the external bottle shape. For example, some designs have provided the lower bottle portion with a more angular shape with the brush positioned at a similar angle. The general intent seems to be to allow the brush to more easily access polish once the polish is at a low level in the bottle. However, these solutions have also met with limited success.

Accordingly, improved fluid and/or nail polish applicators are desirable.

BRIEF SUMMARY

Embodiments of the present invention provide fluid applicator systems that allow access to product located at the bottom of the bottle toward the end of the useful lifetime of the product. There is provided a platform that moves with respect to the bottle base and an applicator that moves with respect to the cap.

DETAILED DESCRIPTION

Figure 1A:
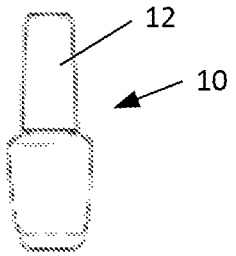
FIG. 1A shows a conventional nail polish bottle.
Figure 1B:
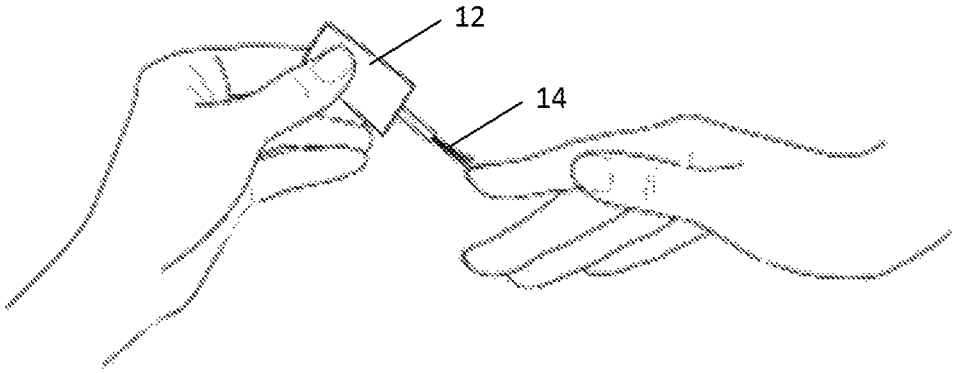
FIG. 1B shows a conventional nail polish bottle cap with an applicator brush extending therefrom.

Embodiments of the present invention thus provide improved fluid applicator systems. Particular embodiments find use with fluids that are applied with a brush applicator that is attached to a cap that screws (or otherwise secures) onto a bottle containing the fluid to be dispensed/applied. A primary example is a nail polish bottle 10 and applicator cap 12, as illustrated by FIG. 1A. Nail polish bottles typically hold an amount of polish product to be applied. The nail polish bottle cap 12 typically has a brush 14 secured thereto, as illustrated by FIG. 1B. Although this disclosure focuses on nail polish bottles and applicator brushes/caps, it should be understood that the features disclosed herein may be used in connection with other fluids to be dispensed. For example, this disclosure may similarly relate to other products that may be contained in a bottle and applied with an applicator that reaches into the bottle. Examples include but are not limited to liquid bandage materials, canker sore or other mouth treatment medicines, wart or other skin medicines, antiseptics, rubber cement or other glues or adhesives, gloss or lipstick, liquid foundation, perfume container, or any other options.

The improved bottles 20 described herein have a cap 22 with an applicator 24 secured thereto. In the examples shown, the applicator 24 has a brush feature 26 at the end thereof. This embodiment is particularly useful in applying nail polish. In some examples, the brush is suitable to prevent product from clumping and can be cleaned after several uses if need be. However, it should be understood that a brush need not be present for liquids that are applied with a dropper-like applicator or wand-like applicator. Rather than being secured in a stationary manner, the applicator 24 is movable with respect to the cap 22. Any appropriate mechanism that may cause upward movement of the applicator 24 is possible and considered within the scope of this disclosure.

Figure 2:
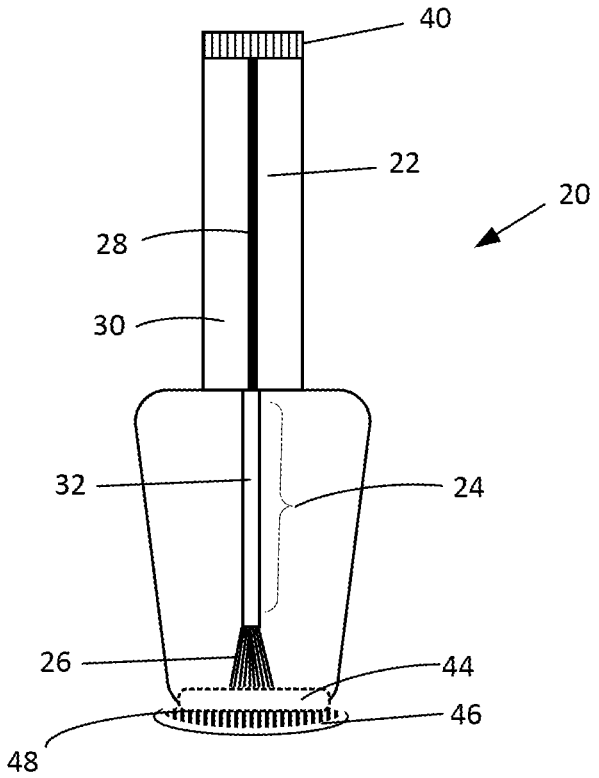
FIG. 2 shows a side cross-sectional view of a nail polish bottle according to certain embodiments described.
Figure 3:
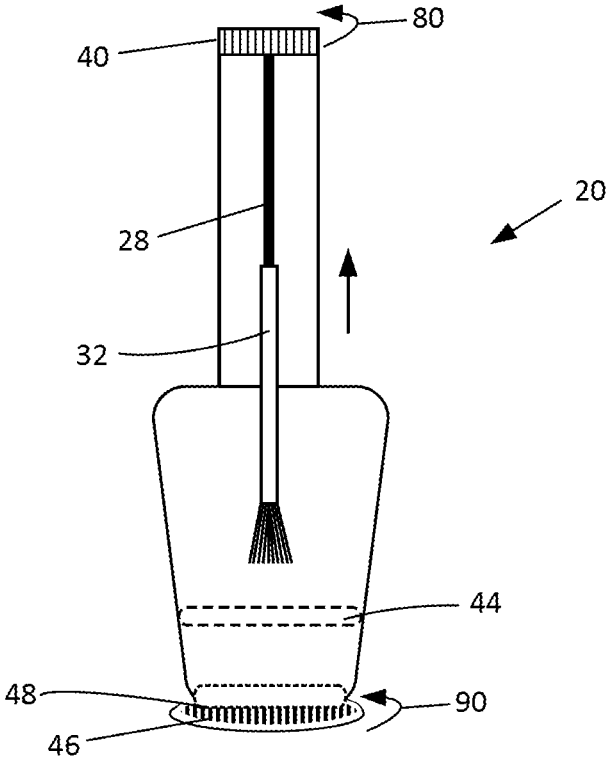
FIG. 3 shows a side cross-sectional view of the nail polish bottle of FIG. 1 with the applicator being retracted and the platform being raised.

In the examples shown by FIGS. 2 and 3, the cap 22 has a support member 28 positioned within an interior cap space 30. The support member 28 supports movement of an extension/retraction member 32. Movement of the extension/retraction member 32 may occur upon activation of a cap twistable feature 40 positioned along cap 22. Although the cap twistable feature 40 is illustrated as located at the top portion of cap 22, it should be understood that the cap twistable feature 40 may be positioned anywhere along the cap 22, such as along the middle portion or along the lower portion, if desired.

Figure 4:
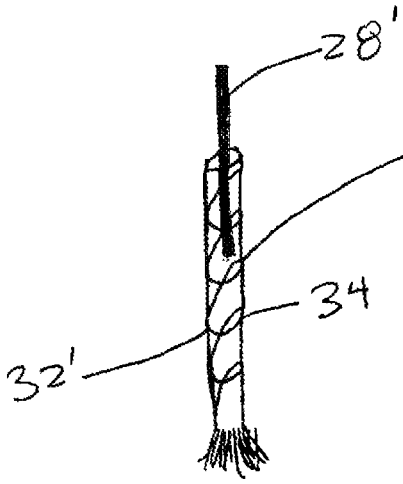
FIG. 4 shows one embodiment of the extension retraction member having a hollow lumen.
Figure 5:
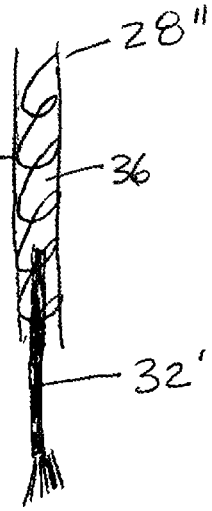
FIG. 5 shows another embodiment of support member having a hollow lumen.

In the embodiment illustrated by FIG. 4, the extension/retraction member 32' is shown having a hollow lumen 34 that travels over of the support member 28'. In the embodiment illustrated by FIG. 5, the support member 28" is shown having a hollow lumen 36 within which the extension/ retraction member 32" travels. In either example, the extension/retraction member 32 or the support member 28 may be provided with a series of threads, and the lumen 34 or 36 may be provided with have a series of corresponding grooves or thread-receiving portions 38, which can allow related movement of the extension/retraction member therealong. (It should be understood that these features may be switched, such that the lumen 34 or 36 is provided with a series of threads and the extension/retraction member 32 is provided with a series of corresponding grooves or thread-receiving portions.)

Figure 6:
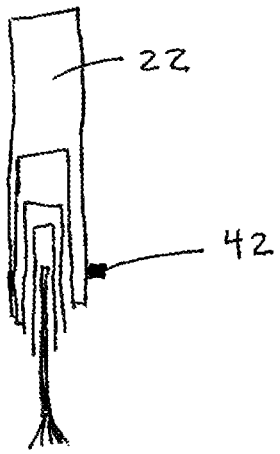
FIG. 6 shows one embodiment of a retractable member.

In an alternate embodiment illustrated by FIG. 6, it is possible for the extension/retraction member to telescope within the cap 22. A side activation feature 42 may be provided to effect the desired telescoping action at the appropriate time.

When the cap twistable feature 40 is twisted as illustrated by the arrow 80 in FIG. 3, or when the side activation feature 42 is activated, the applicator 24 is caused to raise or lower with respect to the cap 22.

The figures also illustrate that the nail polish bottle 20 has a raise-able and lower-able platform 44. The general intent is that when nail polish product or other fluid in the bottle 20 becomes hard to reach with the applicator 24, the platform 44 may be raised and the applicator 24 may similarly be raised. Any appropriate mechanism that may cause upward movement of the platform 44 is possible and considered within the scope of this disclosure.

Figure 7:
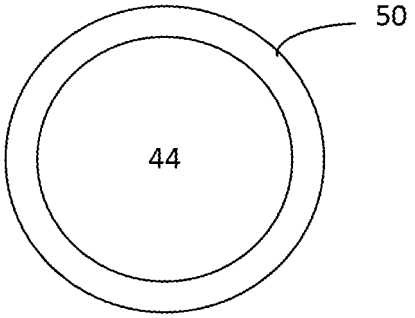
FIG. 7 shows a top plan view of a platform with an external flexible ring.

In one example, there is provided a bottle twistable feature 46. The bottle twistable feature 46 may be rotated as indicated by the arrow 90 in FIG. 3. This may cause the platform 44 to lift upwardly from the bottle base 48. Depending upon the shape of the bottle 20, it may be necessary for there to be a silicone or other flexible material ring 50 extending around edges of the platform 44. One example is illustrated by FIG. 7. The ring 50 can function as a squeegee, which ensures all polish product or other fluid moves upwardly with the platform 44. For example, it may function to scrape the polish product up the sides of the bottle so that the polish travels with the platform 44.

Figure 8:
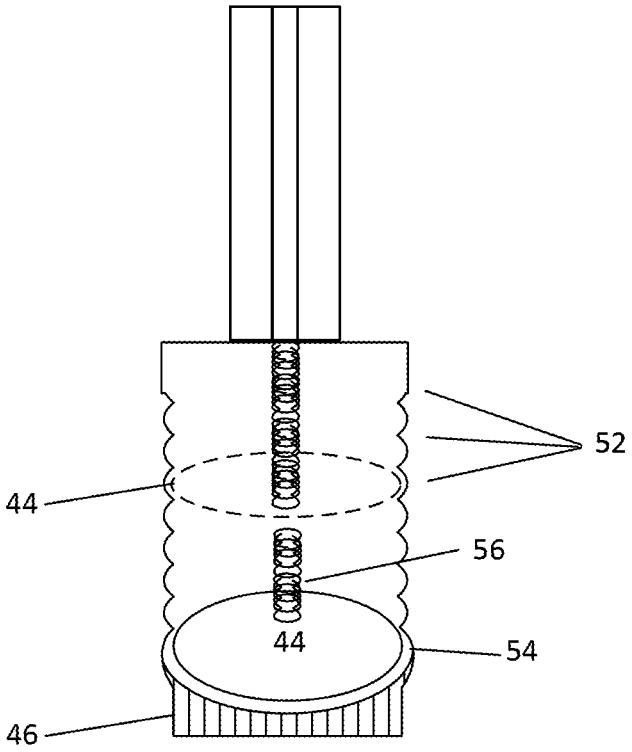
FIG. 8 shows a side cross-sectional view of a bottle having a central core and ridges along the sides.

In a further example, the bottle may have ridges 52 along its sides. Ridges 52 may function as grooves that receive side edges 54 of the platform 44 as the platform 44 is caused to move upwardly. One example is illustrated by FIG. 8. An internal structure 56 may be secured to the base of the platform 44 in order to help bias the platform upward when the twistable feature 46 is activated. In this example, structure 56 may be a spring. In another example, structure 56 may be a threaded feature 62 as described below. When the bottle twistable feature 46 is rotated, the platform 44 is caused to move up the structure 56. This effectively lessens the available space for polish in the bottle, moving it up closer to the bottle mouth/opening.

Figure 9:
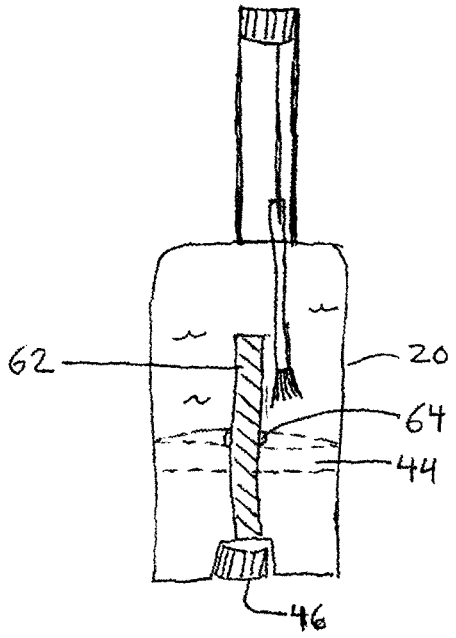
FIG. 9 shows a side cross-sectional view of an offset extension retraction member with a central rod for raising and lowering of the platform.

For example, as illustrated by FIG. 9, there may be provided an internal rod or screw or other threaded feature 62 secured to the base of the bottle 20. The platform may have an opening 64 that receives the feature 62. The opening 64 may have corresponding threaded portions that cause the platform 44 to move up the threaded feature 62 upon activation of the twistable feature 46. This mechanism may be similar to those used to advance deodorant for use. In this example, it may be necessary of the applicator 24 to be offset so that it does not interfere or otherwise contact the threaded feature 62.

Figure 10:
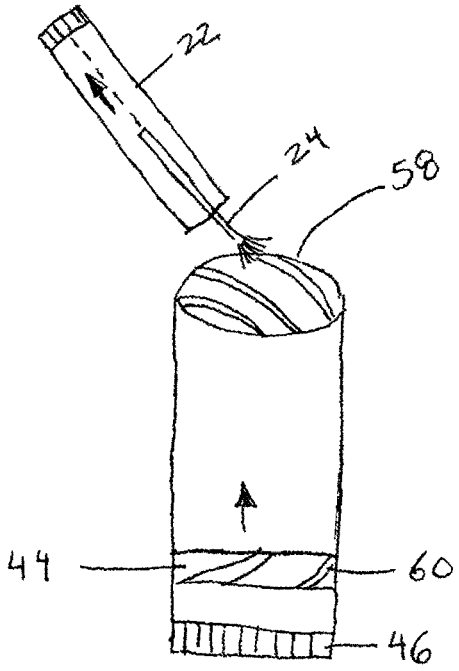
FIG. 10 shows a side view of an alternate embodiment for raising and lowering the platform.

In another example, the bottle may have in internal grooves 58 that cooperate with a partial external thread 60 on the platform 44. This example is illustrated by FIG. 10. Twisting of the bottle twistable feature 46 can cause upward movement of the platform 44 due to engagement of the partial external thread 60 with the internal grooves 58 on the bottle 20. This can prevent the need for having an internal rod or screw or other feature extending up the middle of the bottle.

In another example, there may be a side handle or lever attached to the outside of the bottle, and which is also attached to the platform. The user may press the side handle or lever in order to push the platform up. A similar side handle or lever may be used to retract the applicator in the cap as well.

Figure 11:
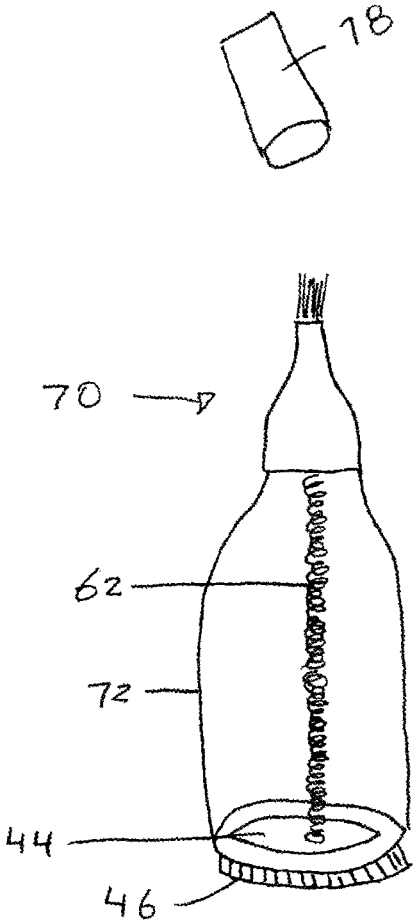
FIG. 11 shows a side cross-sectional view of a bottle having an upper applicator brush.
Figure 12:
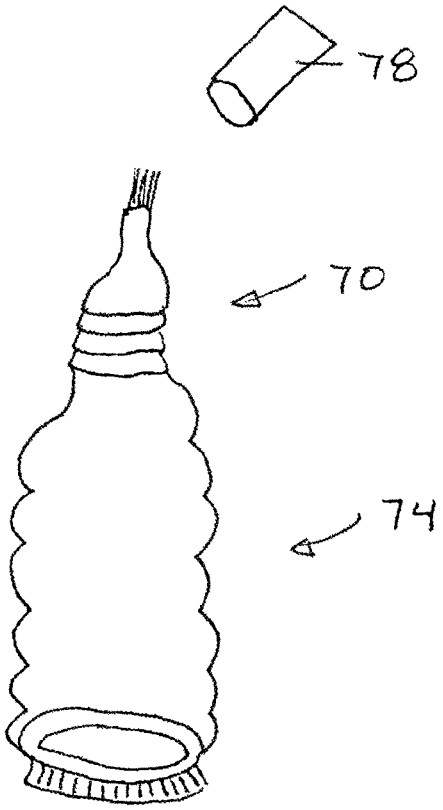
FIG. 12 shows a side view of a squeezable/collapsible bottle having an upper applicator brush.

A further bottle example is provided by FIGS. 11 and 12. In FIG. 11, the bottle includes a threaded feature 62, a platform 44 and a bottle twistable feature 46 for causing movement of the platform 44. In this example, however, the polish product is expelled through an applicator tip 70. The outer sides 72 of the bottle may be made of a flexible material, such that the bottle can be squeezed to expel nail polish product. When dispensing becomes low, the user may twist the teacher 46 in order to cause the platform to move upwardly within the bottle. This can force additional product closer to the applicator tip 70. These figures also illustrate a bottle cap 78 for protecting the applicator tip 70. The bottle cap 78 may be provided with nail polish remover or other cleaning solution reservoir or pad that will help clean the brush between uses in order to prevent clumping of the product. FIG. 12 illustrates a similar embodiment having an applicator tip 70. However, this example provides a collapsible bottle 74. When dispensing becomes low, the user may compress the bottle 74 in order to cause the bottle base to move closer to the bottle mouth. This example is also illustrated as having a collapsible applicator tip. These collapsible options may be incorporated with any of the other embodiments disclosed.

In any of the examples described herein, it is possible for the bottle itself to be colored in order to protect the product from drying out. This can also help with brand recognition, such that all a bottles in a line have a similar appearance to purchasers. A label on the top or bottom or somewhere along the bottle may be used to indicate the particular nail polish color contained therein.

Changes and modifications, additions and deletions may be made to the structures and methods recited above and shown in the drawings without departing from the scope or spirit of the disclosure or the following claims.

What is claimed is:

1. A bottle and applicator system, comprising:

a bottle designed to contain a fluid to be dispensed, wherein the bottle comprises a platform that is movable with respect to a bottle base;

a cap comprising an applicator secured thereto, wherein the applicator is moveable with respect to the cap, further comprising a cap twistable feature configured to cause the applicator to extend or retract with respect to the cap.

2. The system of claim 1, further comprising a bottle twistable feature configured to cause the platform to raise or lower with respect to the bottle base.

3. A bottle and applicator system, comprising:

a bottle designed to contain a fluid to be dispensed, wherein the bottle comprises a platform that is movable with respect to a bottle base;

a cap comprising an applicator secured thereto, wherein the applicator is moveable with respect to the cap, wherein the applicator comprises a support member and an extension/retraction member.

4. The system of claim 3, wherein one of the support member or the extension/retraction member comprises a hollow lumen.

5. The system of claim 1, wherein the applicator feature comprises a telescoping applicator.

6. The system of claim 1, further comprising a threaded feature extending from the bottle base along which the platform is configured to move.

7. The system of claim 6, wherein the platform comprises an opening configured to receive the threaded feature.

8. A bottle and applicator system, comprising:

a bottle designed to contain a fluid to be dispensed, wherein the bottle comprises a platform that is movable with respect to a bottle base;

a cap comprising an applicator secured thereto, wherein the applicator is moveable with respect to the cap, wherein the platform comprises a flexible ring.

9. A bottle and applicator system, comprising:

a bottle designed to contain a fluid to be dispensed, wherein the bottle comprises a platform that is movable with respect to a bottle base;

a cap comprising an applicator secured thereto, wherein the applicator is moveable with respect to the cap, wherein the bottle comprises internal grooves and the platform comprises a partial external thread.

10. A bottle and applicator system, comprising:

a bottle designed to contain a fluid to be dispensed, wherein the bottle comprises a platform that is movable with respect to a bottle base;

a cap comprising an applicator secured thereto, wherein the applicator is moveable with respect to the cap, wherein the platform is associated with a side handle that is used to raise the platform in use.

11. The system of claim 1, wherein the bottle is a colored container in order to protect the fluid contained therein from drying out.

12. A method for applying nail polish, comprising:

providing a bottle and applicator system comprising:

a bottle designed to contain a fluid to be dispensed, wherein the bottle comprises a platform that is movable with respect to a bottle base;

a cap comprising an applicator secured thereto, wherein the applicator is moveable with respect to the cap, wherein the fluid contained in the bottle is nail polish;

using the applicator to apply nail polish to a user;

when nail polish level in the bottle becomes low, moving the platform upward and moving the applicator upward with respect to the cap.

13. The system of claim 3, further comprising a bottle twistable feature configured to cause the platform to raise or lower with respect to the bottle base.

14. The system of claim 3, further comprising a threaded feature extending from the bottle base along which the platform is configured to move.

15. The system of claim 8, further comprising a bottle twistable feature configured to cause the platform to raise or lower with respect to the bottle base.

16. The system of claim 8, further comprising a threaded feature extending from the bottle base along which the platform is configured to move.

17. The system of claim 9, further comprising a bottle twistable feature configured to cause the platform to raise or lower with respect to the bottle base.

18. The system of claim 9, further comprising a threaded feature extending from the bottle base along which the platform is configured to move.

* * * * *